US005848111A

United States Patent [19]

Wells et al.

[11] Patent Number: 5,848,111

[45] Date of Patent: Dec. 8, 1998

[54] SPENT NUCLEAR FUEL CONTAINER

[75] Inventors: Alan Harvey Wells, Duluth; William Francis Howe, Norcross, both of Ga.

[73] Assignee: Advanced Container Int'l, Inc., Norcross, Ga.

[21] Appl. No.: 511,939

[22] Filed: Aug. 7, 1995

[51] Int. Cl.[6] ..... G21F 5/008

[52] U.S. Cl. ..... 376/272

[58] Field of Search ..... 376/272; 250/506.1, 250/507.1

[56] References Cited

U.S. PATENT DOCUMENTS

| | | | |
|---|---|---|---|
| 2,514,909 | 7/1950 | Strickland | 376/272 |
| 3,229,096 | 1/1966 | Bonilla et al. | 376/272 |
| 4,666,659 | 5/1987 | Lusk et al. | 376/272 |
| 4,800,062 | 1/1989 | Craig et al. | 376/272 |
| 4,827,139 | 5/1989 | Wells et al. | 376/272 |
| 4,997,618 | 3/1991 | Efferding | 376/272 |
| 5,102,615 | 4/1992 | Grande et al. | 376/272 |

*Primary Examiner*—Daniel D. Wasil

[57] ABSTRACT

The specification describes a container for spent nuclear fuel rods. The basket of the container comprises a plurality of stacked interlocking grid storage assemblies having an "egg crate" structure. The interlocking grid assemblies have radial tab extensions that extend through an intermediate shell and are affixed to an outer casing. The intermediate shell and the outer casing provide double containment, and the radial tab extensions provide heat sinks for transfer of heat from the storage grid assemblies to the exterior of the container.

8 Claims, 5 Drawing Sheets

SPENT NUCLEAR FUEL CONTAINER

FIELD OF THE INVENTION

The invention relates to spent nuclear fuel storage and transport containment systems and more specifically to basket structures and thermal heat sinking systems that are compatible with low cost, concrete, spent nuclear fuel containment.

BACKGROUND OF THE INVENTION

As the nuclear power industry matures, the issue of safe storage, transport and disposition of spent nuclear fuel becomes increasingly critical. While the original intent in the industry was to reprocess spent fuel, that option has been delayed by a variety of cost and political concerns. Central storage of spent nuclear fuel in containers pending resolution of those issues, and in anticipation of future reprocessing, has been an industry goal, and storage containers for spent fuel have been designed in many cases in anticipation of hauling quantities of spent fuel over long distances to central storage facilities. The hauling of radioactively and thermally hot nuclear materials over public thoroughfares is highly regulated, and the containers for such materials must meet rigid safety and engineering standards. For this reason, the design and construction of containers for these materials is complex and expensive. However central storage of spent nuclear fuel has also been met with difficult regulatory and political issues, and to date has not been implemented on a large scale. Instead, nuclear power plants have resorted to on-site storage of spent fuel. Several plants have constructed expensive storage facilities for spent fuel utilizing water pools in which containers of spent rods are immersed. The surrounding water provides thermal cooling of the thermally "hot" materials, and affords radiation protection and isolation from the environment. However, pool capacity is limited and in some cases exhausted, and nuclear power plants are pursuing new and more economic strategies for handling spent fuel, including on-site dry storage.

Previously, thin walled containers were developed and utilized for ease in handling. These containers could be lowered directly into the fuel storage pool, loaded with spent fuel rods, and once sealed, removed from the fuel pool and transferred to an outdoor storage area. This technology was attractive since it could be handled easily by utilities and due to its structural advantages, transported directly from the utilities to a central storage facility or to an underground repository.

While thin walled metal transport and storage casks proved technically feasible, they also proved expensive. New technology, primarily storage only concrete containers were developed at a cost 6–8 times less expensive when compared to the metal containers. These concrete containers were approved for storage only and involved complex handling equipment and procedures since the large concrete containers could not be lowered into the fuel storage pool. In order to effect transfer, a thin walled metal transfer cask was lowered into the fuel pool, loaded with fuel and sealed. Its contents were transferred outside the fuel pool.

Engineering issues for on-site dry storage containers are primarily thermal cooling and radiation shielding. Radiation shielding can effectively be incorporated in storage containers using thick steel walls or thick walls of other high radiation cross section materials, but this approach to radiation shielding results in a very heavy and very expensive container. The preferred solution from a cost standpoint is to use a concrete container. Concrete typically contains a significant amount of hydrated water which acts as an effective neutron radiation shield, and also contains iron aggregates which are effective in shielding gamma radiation. However, with anticipated storage times of months and years, or even decades, thermal issues are paramount. Storage of radioactive materials involves the use of sealed containers, and it is difficult to effectively cool materials that are generating heat inside of a sealed container. It is especially difficult if the container is concrete, or contains a concrete layer, as concrete is a poor heat transfer medium. Thus a satisfactory concrete storage container for thermally hot nuclear materials has not been available in the industry.

BRIEF SUMMARY OF THE INVENTION

With these and other industry realities and engineering constraints as a necessary framework, we have designed an improved container or "cask" for containing spent nuclear materials. The new design incorporates a novel thermodynamic system for efficient heat transfer from the sealed interior of the cask to the exterior. It also provides a high efficiency mechanical system for high container strength. In addition it provides double containment for sealing the cask against the atmosphere, and effective radiation shielding. Moreover, it utilizes concrete for radiation shielding, thus reducing the cost of storage containers and meeting a primary need in the industry. Added together these advantages establish a new level of safety and cost efficiency for spent fuel rod containers.

Contributing to the achievement of these goals according to the invention is a multi-unit storage array, frequently termed a basket, in which several storage elements are formed from stacked units of an interlocking grid array. The interlocking array is mechanically coupled to an integral polygonal, e.g. octagonal, intermediate metal shell. The intermediate metal shell is embedded inside a rigid cylinder of filler material, e.g. concrete, and this assembly is sealed in an outer casing of high strength metal, e.g. steel. A key to the design is that the interior integral array of tubular supports comprises radial members that extend through the intermediate shell, through the rigid cylinder of filler material, and efficiently couple both mechanically and thermally to the outer metal casing. These radial members both impart strength to the mechanical system, and act as heat sinks for effectively conducting potentially dangerous levels of heat generated by the nuclear waste material to the exterior of the cask. As will be evident, the cask in this design has a first containment barrier at the intermediate shell and a second containment barrier at the outer steel casing. Thus the structure affords dual containment of the atmosphere sealed within the container.

DETAILED DESCRIPTION

Figure 1:
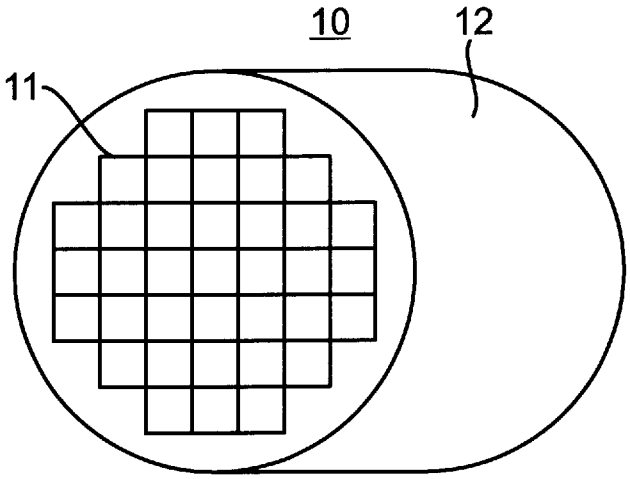
FIG. 1 is a schematic diagram of the basic units of a typical spent nuclear fuel container.

The basic technology for spent fuel containers in use today can be described using a convenient schematic drawing, i.e. FIG. 1. With the goal of storing spent fuel in the form of elongated rods the basic unit of the container is an elongated tube. Tubes are typically grouped in tubular assemblies, collectively the spent fuel basket, such as the assembly 11 shown in FIG. 1, and the basket is placed within a container 12. The container 12 is cylindrical in cross section for maximum strength. The tubes in the basket 11 may be circular in cross section, or may have a square or rectangular cross section and are packed to maximize storage efficiency. In the prior art the basket 11 has been made in a variety of configurations to optimize the space within the cylindrical container. The structure and composition of these tubes and tube assemblies is known in the art and is described, for example, in U.S. Pat. No. 4,827,139 issued May 2, 1989. It is also known that such prior art tube assemblies are expensive to construct.

The basket assembly of the invention eliminates the elongated tubes, reduces costs and is constructed in a novel and efficient way as will be described in conjunction with FIGS. 2–7. As will be appreciated as this description proceeds there is an important distinction between the tubes typical of the prior art, and what we believe are more aptly described as compartments in the structure to be described. In the usual multi-tube array, there are two tube walls separating the individual storage sites, and there typically is a gap or void between at least portions of these walls. By contrast it will be seen that the individual storage sites in the structure of this invention are separated by one wall thus eliminating the potential for gaps or voids between storage sites. Because of the significance of this difference, as will become more apparent below, the individual storage sites will be referred to as compartments rather than tubes, and the storage array that is formed as the result of the new structure will be termed a compartmented array rather than a tubular array.

Figure 2:
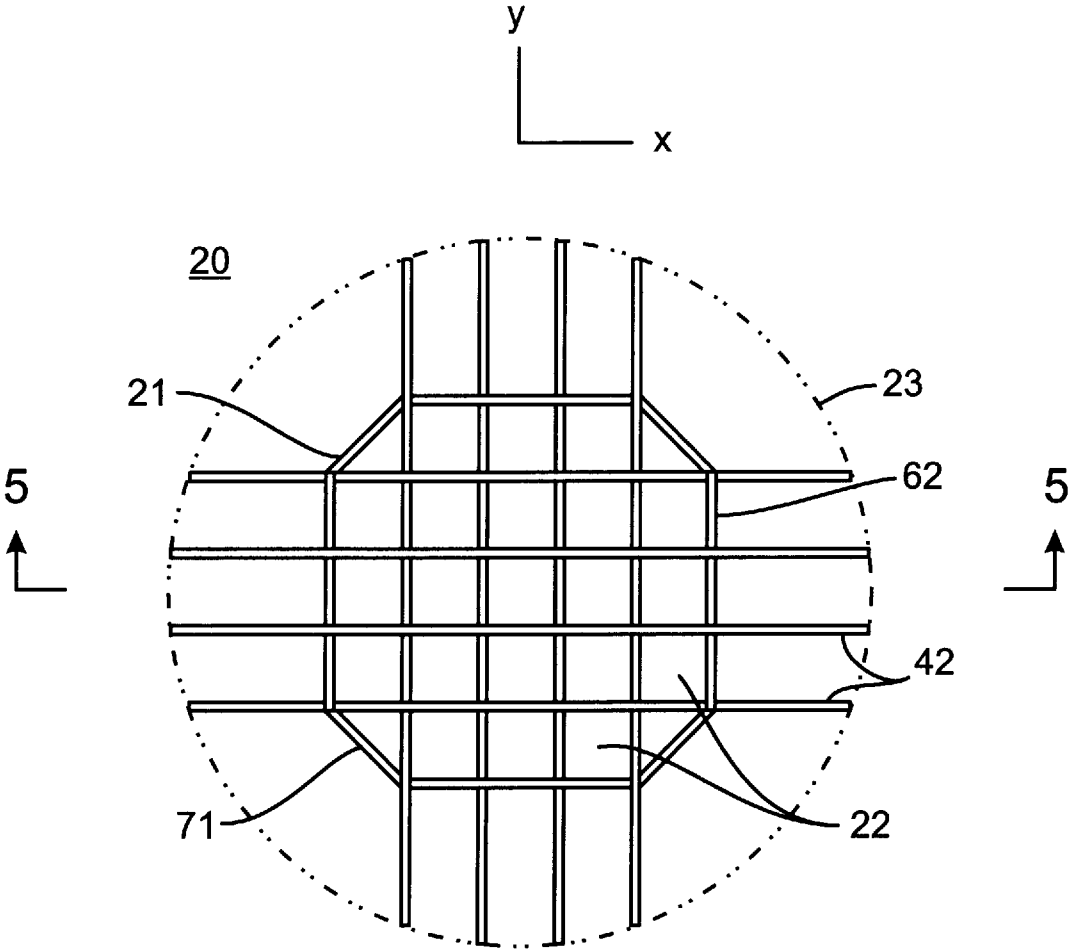
FIG. 2 is a plan view of the spent fuel container of the invention.

With reference to FIG. 2 the container, designated generally 20, is shown in an end view similar to the view seen in schematic FIG. 1, with the compartmented assembly shown generally at 21, the compartments shown at 22, and the outer casing shown at 23. The lateral extensions of the compartmented assembly are shown at 42.

Figure 3:
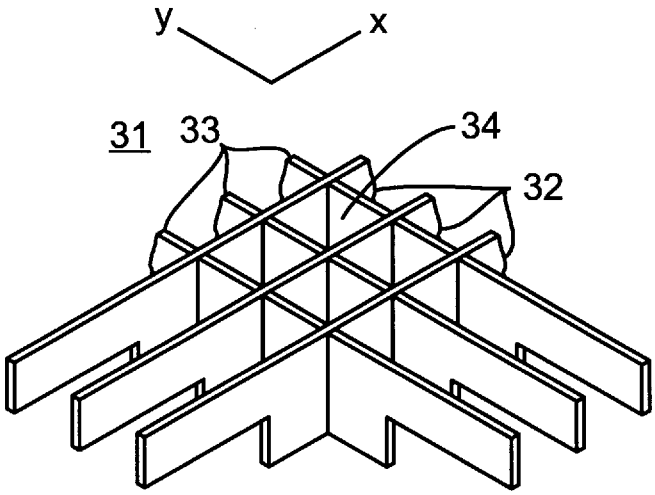
FIG. 3 is a perspective view of a portion of an interlocking compartmented array made according to one aspect of the invention.
Figure 4:
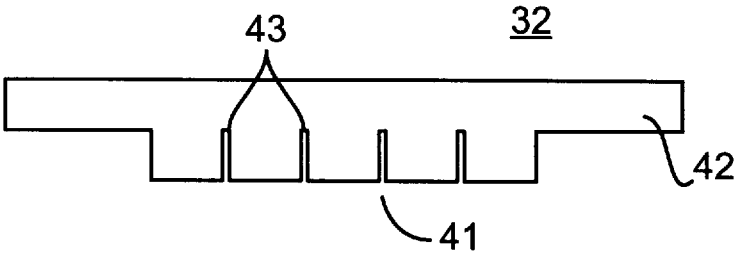
FIG. 4 is a front view of one plate of the interlocking array shown in FIG. 3.
Figure 5:
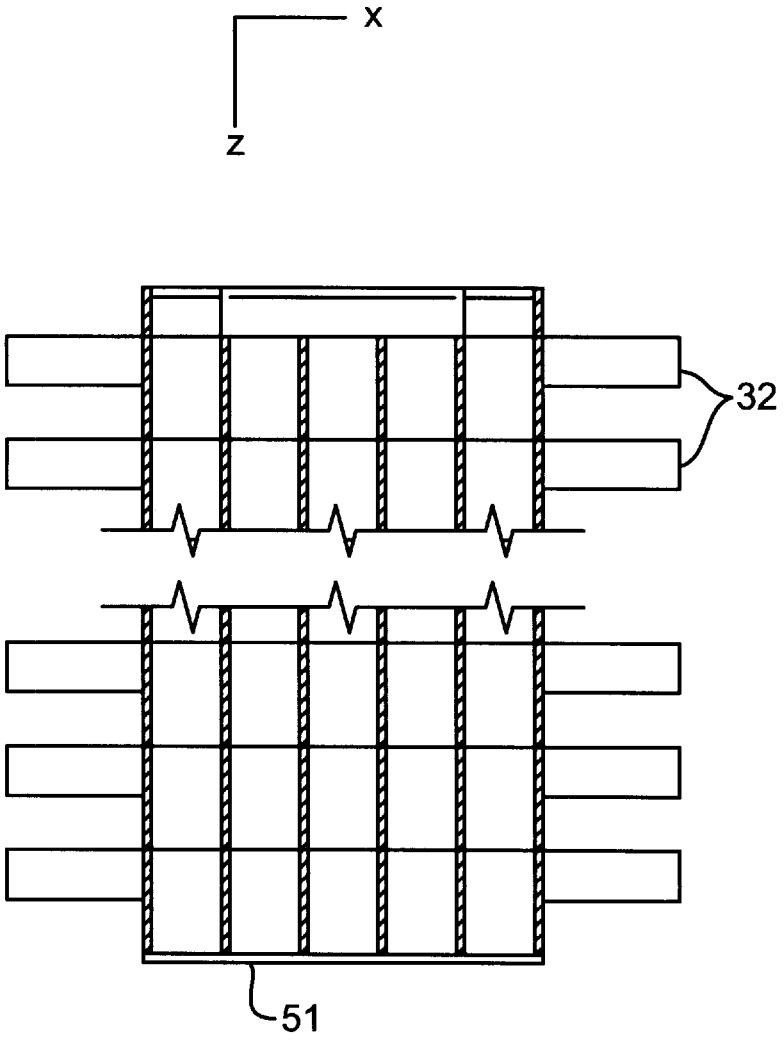
FIG. 5 is a front section through A—A of FIG. 2.

The construction of the compartmented assembly may be more fully appreciated with reference to FIGS. 3 and 4. The structure is modeled after what we term the egg crate principle. The interlocking design is in the form of an x-y grid and is shown in perspective in FIG. 3. Three comb members 32 in the x- dimension and three comb members 33 in the y- dimension form the interlocking unit as shown. While three comb members, forming four compartments 34, are shown in this schematic diagram an actual compartmented assembly could have more comb members in each dimension, or even a different number in each dimension. Since the container is typically cylindrical an equal number of comb members in each dimension is most efficient, and at least four such members in each dimension gives a reasonably useful number of compartments. The comb members may be similar in overall shape, or may have different shapes and dimensions to accommodate different compartmented assembly designs. For cost considerations, the comb members are similar in design. A front view of one of the comb members 32 is shown in FIG. 4 and consists of comb portion 41 and radial tab portions 42. The radial tab portions correspond to the lateral extensions shown at 42 in FIG. 2. The interlocking units 31 of FIG. 3 are stacked to form continuous elongated storage compartments in the manner shown in FIG. 5. FIG. 5 is a sectional view through A—A of FIG. 2. FIG. 5 shows five interlocking units (shown cutaway from a larger stack for simplicity) stacked in a vertical, i.e. z- dimension. The bottom of the stack is sealed with end plate 51.

It will be evident that the use of x-,y-, and z- dimensions is for convenience in providing a clear description of the invention and that the container can be oriented in any dimension during manufacture and use.

Figure 6:
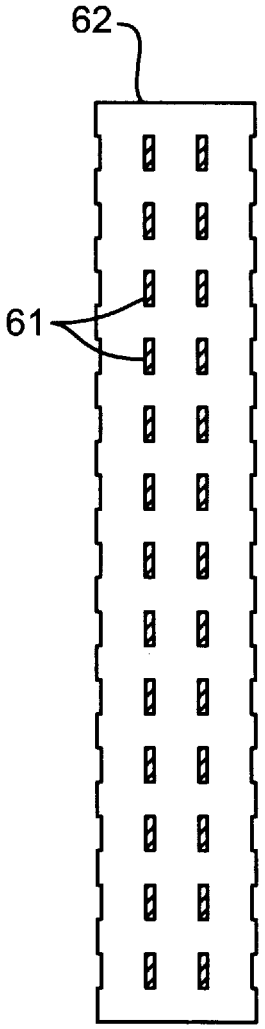
FIG. 6 is a front view of one end plate of the basket assembly shown in FIG. 2.
Figure 7:
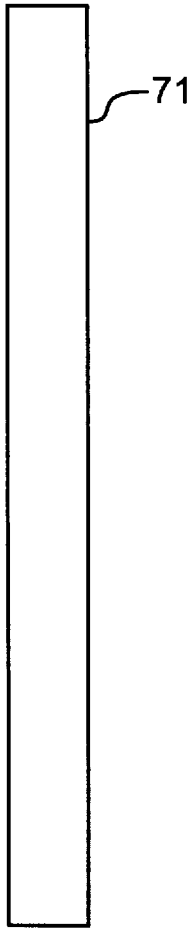
FIG. 7 is a front view of a typical corner plate useful to construct the container shown in FIG. 2.

The intermediate metal shell is formed with the shell end plates 62 shown in FIG. 6, and the shell corner plates 71 shown in FIG. 7. The compartmented array is assembled by inserting the radial tab portions 42 of the interlocking units 31 through the slots 61 of four shell end plates 62, then completing the intermediate shell by fastening. e.g. welding, the corner plates 71 to the end plates 62. The completed compartmented assembly appears in the x-y plane as in FIG. 2.

A notable feature of the container of this invention includes the absence of thermal barriers to heat flow from the center of the container to the exterior wall of the container. The result of the absence of gaps or voids between the compartments, as mentioned earlier, is a continuous thermal path from any given compartment to the exterior of the container. In fact there are multiple thermal paths to the exterior from any point in the compartmented array. This is due to the combination of interlocking plates, i.e. an integral compartmented array, and the thermal connection between the plates and the exterior container wall that is afforded by the lateral extensions of the plates. This principle can be implemented in a variety of structures as will be discussed in more detail below.

Typical details for the design and construction of a spent fuel container according to the invention will be given in the context of the embodiment shown in FIGS. 2–7. It will be understood that this embodiment, while preferred, is exemplary of many possible structures incorporating the principles on which the invention is based.

The individual comb plates shown in FIG. 4 may be manufactured by milling the slots 43 in a sheet of steel of the desired thickness, e.g. a ¾ inch ferritic steel plate. Alternatively the plate may be of stainless steel or other appropriate material. Stainless steel is considerably more expensive and is a less efficient heat conductor so we prefer to use a coated ferritic steel. An aluminum flame-spray can be applied to the comb plates during their production, with any weld areas masked off to prevent weld contamination. Flame-spray techniques and appropriate masking procedures are well known in the art. The plate is in the shape of a slat, having in this embodiment a thickness of ¾ inch as just mentioned, a nominal width of 12" and a length of 84". The length of the tab extensions, or radial heat sinks, 42 is 18", and the slots are ¾"×6" slots spaced at 9". As will be evident from FIG. 2, the length of the tab extensions varies somewhat due to the curvature of the surface of the outer casing 23. The slats used in the other dimension, that interlock with those shown in FIG. 4, may be identical except that the slots 43 extend from the top edge of the slat. The slat structures in this embodiment look somewhat like a comb, hence the terminology "comb plate".

With reference again to FIGS. 3 and 4, the plates 32 and 33 are similar as just described except that the slots extend from the bottom of comb plates 32 and from the top of comb plates 33. If desired the plates 32 and 33 can be identical, i.e. symmetrical, if the tabs extend from the middle of the comb section of the plate.

The individual comb plates are assembled similarly to an egg carton and may be spot welded, or full welded, where the plates join. However, a significant advantage to the construction technique of this invention is that the interlocking of the comb units gives sufficient structural integrity, and provides sufficient heat flow, that welded joints are not necessary. This results in a significant cost saving.

The resulting interlocking grid units are then stacked as shown in FIG. 5, in this embodiment to a height of 160".

The four end plates 62 in FIG. 6 are milled with slots 61 to receive the tab extensions 42 of the comb plates. The slots 61 are spaced so the interlocking grids 31 (FIG. 3) are just touching. It will be appreciated that while the tab extensions 42 are shown in this embodiment with approximately half the plate width the tabs can have any desired width , but preferably less than the plate width. As an alternative, a continuous slot could be used, extending nearly the full length of end plate 61, in place of the multiple slots 61, and thus accommodate grids with tabs having the full width of the plates. The welding of the ends of the radial tab extensions to the end plates can be performed from the exterior of the assembled basket. This facilitates access with a welding torch. The weld between the extensions of the comb plates and the exterior container must be structural but need not be full penetration. A partial penetration weld, combined with a fillet weld will give adequate strength and facilitate welding and dye penetrant weld inspection of the root and final weld passes.

The bottom plate 51, shown in FIG. 5, is welded onto the bottom end of the finished container to close off the containment structure. The bottom end plate may be welded only at the outer periphery of the structure; there is no need to weld the interlocking grid assemblies to the bottom plate.

After assembly of the interlocking grid units and the end plates, the corner plates 71 (FIG. 2) are added. The purpose of the corner plates is twofold: they act to stabilize the structure by connecting adjacent end plates, and they displace concrete from the final cask as will be evident after the next step. Alternatively, corner plates 71 can be omitted and the width of the end plates extended so they meet together to form an essentially square cross section as viewed in FIG. 2.

The finished basket is prepared for concrete pour by installing reinforcing bars (rebar) in the circumferential and longitudinal directions. The rebar size is chosen to provide adequate structural strength for the finished cask, while maintaining a small enough diameter and sufficient spacing to allow the concrete aggregate material to pass between the pouring form and the basket wall. Superplasticizer may be added to the concrete mix to reduce the tendency to form voids in the concrete. Types of concrete, and mixing and curing methods, are well known in the art. Again, as known in the art, some aggregates, e.g. aggregates high in iron content, are preferred over others due to higher gamma radiation cross section. Insulating material may also be applied to the basket exterior and to the comb plate tabs to prevent excessive temperatures in the concrete when the cask is placed in service. Insulation should be restrained to prevent dislocation during the pour.

After concrete pour, the concrete is allowed to cure. The concrete pouring forms are removed after the concrete has set up, and up to several weeks are allowed for a complete concrete cure. The thickness of the concrete layer of the cask, which corresponds generally to the length of the tab extensions on the interlocking grid assemblies (31, FIG. 3), is determined by the dose rate requirements for handling of the spent fuel cask during fuel loading and movement to the cask storage site. In the embodiment described above the concrete thickness is approximately 18".

The outer casing 23 of the container is applied by plug-welding curved sections of steel to the comb plate tabs 42. The bottom plate is welded to these steel sections. These outer casing plates may have a thickness of typically ⅛ to ½ inch and may consist of stainless steel or other appropriate thermally conductive material. This outer casing represents a second containment vessel so that there are two air tight seals.

In use, the spent nuclear fuel rod is loaded into each of the compartments, an inert gas such as helium or nitrogen is pumped into the container, and the container is sealed with a cover. The cover may be a thick, e.g. 7", steelcover that is gravity sealed, or sealed by other appropriate methods, onto the top of the container.

In the structure of FIG. 2 the heat transfer members 42 are generally sufficient in number to be effective for the purposes described. However, if desired, additional radial heat transfer members can be provided. For example, additional radial members can be affixed between the corner plates 71 and the outer casing 23. Another cooling expedient is to extend radial members 42 through the outer casing and attach cooling fins to the outer ends of the radial members. If this expedient is properly implemented a wider choice for the material of the outer casing may be available, i.e. the thermal conductivity requirements of the outer casing are less important. For example, high strength, lightweight and non-corroding polymer materials may be used. In the preferred embodiment of FIGS. 2–7 the basket structure is described as an interlocking "egg crate" grid. However, still within the spirit of one important aspect of the invention, other types of grids can be used. According to this aspect of the invention a grid assembly similar to that appearing in FIG. 2, i.e. a grid assembly with radial thermal heat sink members, can be made by other techniques. For example, the compartmented geometry shown in FIG. 2 can be cast from an appropriate material such as steel, or a high strength, thermally conductive alloy. The use of casting as a method for making the basket assembly allows flexibility in the design of the basket. For example, a grid cross section like that shown in U.S. Pat. No. 4,827,139 can be easily cast. Other arrangements for space efficiency, like hexagonal close packed arrays, can also conveniently be implemented using casting techniques.

The spent fuel cask may provide the entirety of the required radiation shielding itself, or it may be placed within a simple concrete structure that provides additional shielding. Such an additional structure, or overpack, may be ventilated to allow cooling air to remove heat from the cask.

The spent fuel cask of the invention may also be inserted into a steel overpack for shipment to a central storage facility. The steel overpack provides additional puncture resistance and impact absorbing ability in transport.

Various additional modifications of the invention as described here will occur to those skilled in the art. All such variations and deviations which basically rely on the teachings through which this invention has advanced the art are properly considered within the scope of this invention and equivalents thereof, as described herein and claimed in the appended claims.

I claim:

1. A basket assembly for a spent nuclear fuel container comprising:

a series of compartmented units stacked in a vertical or z-dimension, said compartmented units comprising an x-y array of interlocking comb plates, each of said plates having a slat shape and having, along the length of the slat, a comb portion, and a tab portion extending from each end of the comb portion, the width of the comb plate along the tab portion being less than the width of the comb plate along the comb portion, the comb plates further having slots formed on one side thereof and located so as to engage a slot on another of said comb plates, a first plurality of comb plates oriented in the x- dimension and a second plurality of comb plates oriented in the y- dimension with slots of the comb plates oriented in the x- direction in interlocking engagement with slots in the comb plates oriented in the y- dimension so as to form an interlocking compartmented array of essentially square compartments with a plurality of tab portions extending from each side of said compartmented array in the x-dimension and a plurality of tab portions extending from each side of the compartmented array in the y-dimension, said tab portions arranged so that the ends of the said tab are aligned in the z- dimension, the basket assembly further comprising four end plates, each end plate having a length corresponding approximately to the height of the stack of compartmented units, and a width corresponding approximately to the length of the comb portion of the comb plates, the end plates further having a row of slots therein, said row of slots being in alignment in the z- dimension and through which the tab portions of the stacked units extend, so that the end plates are essentially in contact with the comb portions of the interlocking comb plates and the tab portions extend beyond the end plates for a distance approximately equal to the length of the tab portions, and means for attaching the end plates to the interlocking comb plates.

2. The assembly of claim 1 further including corner plates connecting the outer plate of each plurality of x- dimension comb plates with the adjacent outer plate of each plurality of y- dimension comb plates.

3. The assembly of claim 1 further including a bottom plate attached to the end plates.

4. A spent nuclear fuel container comprising: a basket assembly for a spent nuclear fuel container said basket comprising:

a series of compartmented units stacked in a vertical or z-dimension, said compartmented units comprising an x-y array of interlocking comb plates, each of said plates having a slat shape and having, along the length of the slat, a comb portion, and a tab portion extending from each end of the comb portion, the width of the comb plate along the tab portion being less than the width of the comb plate along the comb portion, the comb plates further having slots formed on one side thereof and located so as to engage a slot on another of said comb plates, a first plurality of comb plates oriented in the x- dimension and a second plurality of comb plates oriented in the y- dimension with slots of the comb plates oriented in the x- direction in interlocking engagement with slots in the comb plates oriented in the y- dimension so as to form an interlocking compartmented array of essentially square compartments with a plurality of tab portions extending from each side of said compartmented array in the x-dimension and a plurality of tab portions extending from each side of the compartmented array in the y-dimension, said tab portions arranged so that the ends of the said tab are aligned in the z- dimension, the basket assembly further comprising four end plates, each end plate having a length corresponding approximately to the height of the stack of compartmented units, and a width corresponding to the length of the comb portion of the comb plates, the end plates further having a row of slots therein, said row of slots being in alignment in the z- dimension and through which the tab portions of the stacked units extend, so that the end plates are essentially in contact with the comb portions of the interlocking comb plates and the tab portions extend beyond the end plates for a distance approximately equal to the length of the tab portions, and means for attaching the end plates to the interlocking comb plates, a bottom plate sealing the bottom edges of the end plates of the basket assembly, a layer of concrete encasing the basket assembly, and an outer cylindrical shell enclosing the concrete layer.

5. The spent fuel container of claim 4 in which the outer cylindrical shell is made of steel.

6. The spent fuel container of claim 4 further including a cover for sealing the top of the container.

7. The spent fuel container of claim 6 further including four corner plates attached to the said end plates so that the combination of end plates, corner plates, bottom plate and cover forms an intermediate air containment shell.

8. The spent fuel container of claim 7 in which the outer cylindrical shell enclosing the concrete forms an air tight container thus providing double air containment for the container.

* * * * *